US005791174A

United States Patent [19]

Fitzgerald et al.

[11] Patent Number: 5,791,174

[45] Date of Patent: Aug. 11, 1998

[54] PADDLE HANDLE LOCKS

[76] Inventors: Marlon R. Fitzgerald, Rte. 1 Box 188 E-1, Homer, La. 71040; Glen W. Beach, 2983 Highway 540, Haynesville, La. 71038

[21] Appl. No.: 660,097

[22] Filed: Jun. 6, 1996

[51] Int. Cl.[6] ..... E05B 13/00

[52] U.S. Cl. ..... 70/212; 70/92; 70/211; 70/489; 292/288

[58] Field of Search ..... 70/14, 92, 416, 70/209, 467, 489, 483–485, 210–212, 201–203, 207, 208, DIG. 31, DIG. 58, 54–56; 292/92, 288, 148

[56] References Cited

U.S. PATENT DOCUMENTS

| | | | |
|---|---|---|---|
| 1,441,336 | 1/1923 | Flowers | 70/210 |
| 1,815,584 | 7/1931 | Prinzler | 70/210 |
| 2,514,317 | 7/1950 | Eichacker | 70/211 |
| 3,374,649 | 3/1968 | Weidman | 70/210 |
| 3,383,130 | 5/1968 | De Avila | 292/288 |
| 4,065,160 | 12/1977 | Gilmore, Jr. | 292/288 X |
| 5,364,140 | 11/1994 | Rice | 292/288 X |

FOREIGN PATENT DOCUMENTS

| | | | |
|---|---|---|---|
| 0408169 | 1/1991 | European Pat. Off. | 70/211 |
| 1432048 | 2/1966 | France | 70/211 |
| 2722746 | 11/1978 | Germany | 70/210 |
| 541656 | 4/1956 | Italy | 70/211 |

*Primary Examiner*—Lloyd A. Gall
*Attorney, Agent, or Firm*—John M. Harrison

[57] ABSTRACT

Paddle handle locks for securing push-pull, paddle-style door latches. In a first preferred embodiment the paddle handle lock is characterized by a handle lock having a frame with parallel side plates separated by spacers and fitted with a clamp arm pivotally attached to one of the spacers. Registering frame pilot holes and clamp arm pilot holes facilitate locking the clamp within the frame, such that the respective spacers prevent movement of the paddle door handle upon which the handle lock device is mounted. The padlock can be removed to allow pivotal extension of the clamp arm and manipulation of the door handle or removal of the handle lock from the door handle, to render the door latch operable. In another preferred embodiment a lockset handle lock is provided which includes a cylinder lock mounted in a lock housing and fitted with a pivoting clamp arm, one end of which clamp arm extends into the lock housing and engages a conventional cylinder bolt on the lock cylinder. The clamp arm normally engages the door handle to maintain the door handle in inoperable condition. However, upon manipulation of a key and the cooperating cylinder, the clamp arm is disengaged from the cylinder bolt and may be pivoted upwardly to disengage the door handle and render the door handle operable.

10 Claims, 3 Drawing Sheets

PADDLE HANDLE LOCKS

BACKGROUND OF THE INVENTION

1. Field of the Invention

This invention relates to removable lock mechanisms for door handles and more particularly, to paddle handle door locks designed for removable attachment to push/pull, paddle-style door handles having a base mounted to the door and a pivoting handle or lever extending from the base for activating the latch bolt in the door. The door handle may be set up for operation by inward or outward pressure, or both, on opposite sides of the doors, depending upon the latch mechanism design.

One of the problems realized in securing various doors equipped with push/pull, paddle-type door latches is that of quickly, efficiently and securely securing these doors against unauthorized entry without providing a lock in the door itself. Doors equipped with this type of door latch/closure typically have no lockset and are therefore not key-activated. Typically, the door latch systems for which the paddle handle locks of this invention are designed may be found in hospitals, nursing homes and other institutions where push/pull access through fairly heavy doors is desired.

The paddle handle locks of this invention are characterized in a first preferred embodiment by a handle lock having a handle lock frame which is defined by a pair of side plates separated in parallel relationship by spacers and designed to fit over the paddle door handle of a push/pull type door latch in order to render the handle immovable while the handle lock is in place. The side plates of the handle lock are fitted with a pair of spaced frame pilot holes that match cooperating clamp arm pilot holes in a pivoting clamp arm that is mounted inside the side plates of the handle lock frame. Accordingly, a padlock may be used to secure the pivoting clamp arm in position between the side plates, with the clamp arm spacer and middle frame spacer lying adjacent to and engaging the door handle, to render the door handle inoperable to open the door. Removal of the padlock facilitates pivoting of the clamp arm outwardly of the side plates to allow manipulation of the door handle and opening of the door.

Similarly, a lockset handle lock includes a cylinder lock mounted in a housing and fitted with a downwardly-extending, pivotable clamp arm which fits over the door handle and may be locked into position to render the door handle immovable and therefore, inoperable. Manipulation of the key in the cylinder lock rotates the cylinder and disengages a cylinder bolt from the top portion of the clamp arm that extends into the cylinder lock housing, to facilitate pivoting of the clamp arm outwardly and manipulation of the door handle to open the door.

2. Description of the Prior Art

Various types of locking devices are known for locking cabinets, drawers, doors and other enclosures. U.S. Pat. No. 1,483,205, dated Feb. 12, 1924, to W. N. Vance, details a "Locker Lock" for locking a locker door in a cabinet, which lock includes a latching bar secured to the door and having projecting latching lugs and a handle fixed to the bar, with recessed straps secured to the casing for cooperating with the lugs to latch the door closed. Multiple locks are providing for locking the bar in latching position, with operation of a single lock releasing the bar to unlock the door. A "Door Latch" is detailed in U.S. Pat. No. 2,655,027, dated Oct. 13, 1953, to Lynxwiler. The door latch includes a lockset fitted in a frame and a linkage mechanism designed to secure a pivoting lever into locked and unlocked configuration. U.S. Pat. No. 2,677,261, dated May 4, 1954, to E. N. Jacobi, details a "Door Handle Lock" which includes a cylinder fitted with an elongated rod having a flange at the end, which rod is operated by a key provided in the cylinder to engage and disengage the door for locking purposes. U.S. Pat. No. 4,131,002, dated Dec. 26, 1978, to Angelo Gianelo, details a "Door Latch" for use with metal lockers or compartments. The latch includes a mounting member with a recess formed on its front and a shaft positioned in the recess and a latch member is mounted to the shaft and extends through an aperture formed in the recess. The aperture is sized such that the latch members are rotatable between a latched position and an unlatched position. A lever is mounted on the shaft to rotate the latch member from the latched position and the lever includes a pawl extending from a first edge along the front of the latch member. Accordingly, as the lever is pulled outwardly from the recess, the pawl contacts the latch member and causes it to rotate. U.S. Pat. No. 4,138,869, dated Feb. 13, 1979, to Albert L. Pelcin, details a "Self Locking, Key-Controlled Door Lock". The door lock includes an automatic self-locking linkage to permit the handle to move out of a nested position after a key control has been operated to "cock" the linkage. Once the linkage has been cocked, the handle can be moved out of and returned to its nested position and thereafter, the linkage operates to retain the handle in its nested position until the key control is again operated to cock the linkage. U.S. Pat. No. 4,510,776, dated Apr. 16, 1985, to William J. McNally, et al, details a "Sliding Access Door for Washing Machine". A horizontally-disposed top cover associated with a washing machine defines an access opening within the washing machine. The top cover also includes guide ways at the sides of the access opening with an access door cooperating with the guide ways for sliding movement, to close the access opening in a first forward position and to uncover the access opening in a second rearward position. The top cover also includes structure for effectively retaining the access door in the guideways in the first forward position and providing a housing for the access door in the second rearward position. U.S. Pat. No. 4,631,937, dated Dec. 30, 1986, to Debus, et al, details a "Lock Assembly For Cabinet Doors". The lock assembly includes a mounting plate which may be attached to the door panel and is provided with a depression in its front face to receive a handle. The handle is connected to an operating shaft for a lock adjusting member in spring-loaded manner. The handle is retained in and released from the depression by means of a lock assembly. The lock controls a slide adjustably disposed in the mounting plate by means of detent element engaged in the depression, the detent element retaining the handle in the depression when the lock is in the locking position and releasing the handle, which is ejected from the depression when the lock is in the unlocked position. U.S. Pat. No. 4,704,882, dated Nov. 10, 1987, to Takasaki, details a "Door Handle and Lock Mechanism". The device is provided with a handle grip attached thereto by a first pivot pin and has an actuating lever connected to the device through the first pivot pin, which is mounted unitarily with the handle grip through a second pivot pin. A reset lever is pivotally secured to the handle grip through the second pivot pin acting on the handle grip. A retractable latch, mounted in the device body, has a lock lever connected thereto by a third pivot pin to check the rearward slide of the latch by engagement with the receiving portion in a bottom plate of the handle device. A lock mounted on the handle grip has a cam lock in engagement with the reset lever secured to a rotor so that when the rotor is turned the reset lever as depressed by a lock cam turns to release the restraint on a lock lever. The lock lever urged upwardly by the leaf frame turns to release its engagement with the receiving portion of the bottom plate and permits the latch to be retracted.

It is an object of this invention to provide new and improved door locks for removably mounting on push/pull, paddle-type door latches and assemblies and rendering the door handles inoperable.

Another object of this invention is to provide a handle lock having a frame characterized by a pair of parallel side plates separated by spacers and a clamp arm pivotally attached to the side plates, wherein the handle lock frame is positioned on the base and paddle handle of a push/pull style door latch or closure to engage the door handle and prevent pivotal manipulation of the handle to open the door.

Another object of the invention is to provide a box lock for push/pull, paddle-type door latches, which lock includes a frame fitted with a pivoting clamp arm and spacers, which frame is mounted on the door latch between the pivoting latch or paddle handle and the latch base and the clamp arm is locked into registering position inside the frame to accommodate a padlock, secure the lock on the door handle and thus prevent manipulation of the door handle and opening the door.

Still another object of the invention is to provide a new and improved lockset handle lock for securing push/pull, paddle-type door latches, which lockset handle lock is characterized by a lockset fitted with a pivoting clamp arm and is designed to seat between the latch base and door and the paddle handle of the door latch, with the clamp arm in downwardly-extending, locked configuration to prevent manipulation of the door handle and opening the door.

A still further object of this invention is to provide a lockset handle lock for mounting on push/pull, paddle-type door latches, which lockset handle lock includes a cylinder mounted in a lock housing, which lock housing is positioned between the door, the lock base and the top end of the handle of the door latch and includes a downwardly-extending clamp arm which is pivotally attached to the lockset housing and engages the cylinder. The clamp arm may be locked into position by means of a key to prevent movement of the door handle and opening the door and may be released for outward pivoting with respect to the lockset housing by turning the key to facilitate release of the door handle and opening the door.

SUMMARY OF THE INVENTION

These and other objects of the invention are provided in new and improved paddle handle locks, the first embodiment of which includes a frame having parallel side members or plates separated by spacers and fitted with a pivoting clamp arm, which frame and clamp arm are designed to seat on the base and handle of a push/pull, paddle-type door latch. The side plates and the clamp arm are fitted with registering openings for receiving a padlock to secure the clamp arm inside the frame between the side plates when the handle lock is in locked configuration. When the padlock is removed and the clamp arm is pivoted from the handle lock frame, the spacers in the frame and clamp arm disengage the paddle handle and the paddle handle is then free to pivot outwardly and open the door. If the door latch is set up with the paddle handle in "push" configuration, then the paddle handle lock must be removed from the base before the paddle handle can be depressed to open the door.

In a second preferred embodiment a lockset handle lock is characterized by a cylinder lock enclosed in a lock housing and pivotally receiving a clamp arm which extends downwardly beneath the lock housing, such that the lock housing is wedged between the door, the base and the pivoting paddle door handle of the door latch as the clamp arm also engages the door handle to prevent the door handle from being pivoted outwardly or inwardly to open the door. Insertion of a key in the cylinder lock and rotation of the cylinder frees the clamp arm to pivot outwardly and frees the door handle for manipulation to open the door in the direction of door handle movement. If the door opens inwardly responsive to pushing of the paddle door handle, the lockset handle lock must be removed to manipulate the handle.

BRIEF DESCRIPTION OF THE DRAWINGS

The invention will be better understood by reference to the accompanying drawings, wherein.

DESCRIPTION OF THE PREFERRED EMBODIMENTS

Figure 1:
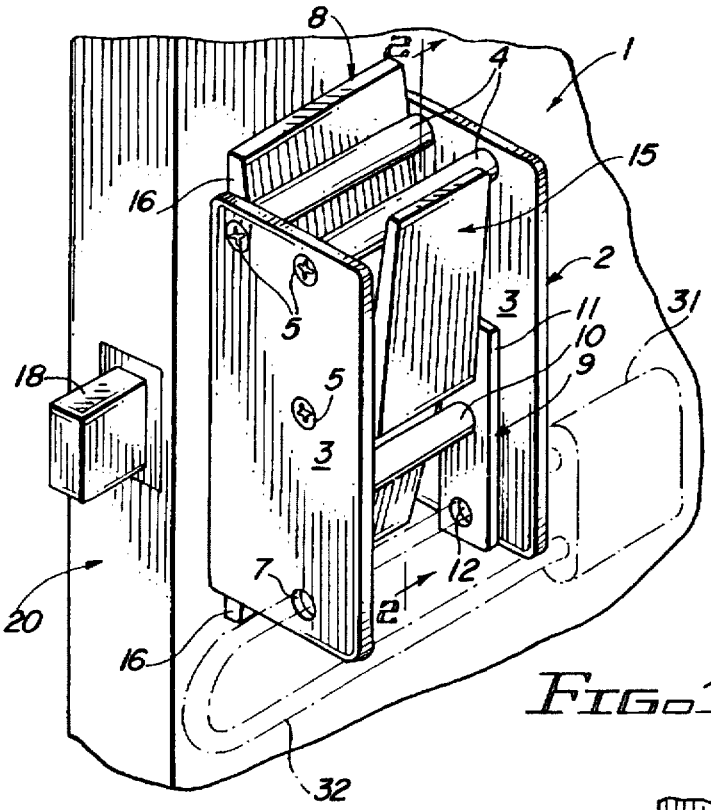
FIG. 1 is a perspective view of a handle lock embodiment of the paddle handle locks in locked configuration on a paddle-type door latch.
Figure 2:
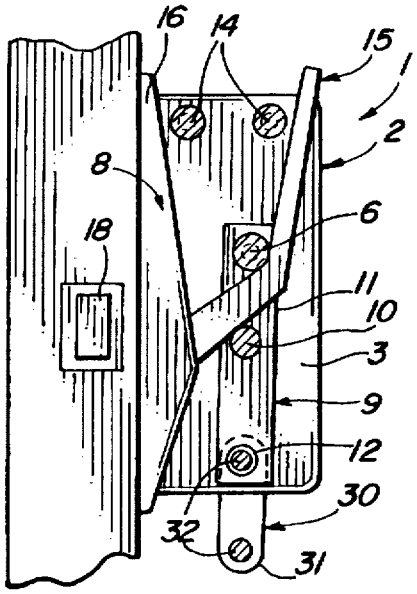
FIG. 2 is a sectional view taken along line 2—2 of the handle lock and door latch illustrated in FIG. 1.
Figure 4:
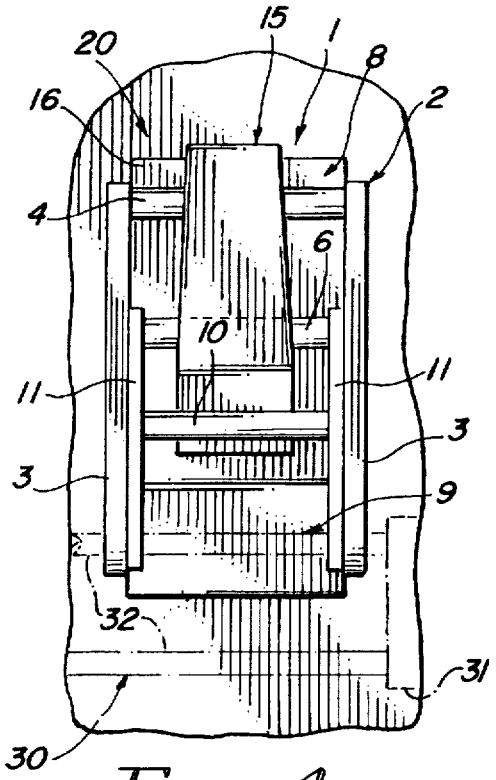
FIG. 4 is a front view of the handle lock and door latch illustrated in FIG. 1 in locked configuration.

Referring initially to FIGS. 1, 2 and 4 of the drawings, in a first preferred embodiment the paddle handle lock of this invention is characterized by a handle lock 1, having a handle lock frame 2, defined by parallel side plates 3, separated by a pair of top frame spacers 4 and a middle frame spacer 6. The top frame spacers 4 and middle frame spacer 6 are typically attached to the side plates 3 by means of spacer bolts 5, as illustrated in FIG. 1, and are spaced with respect to each other. Accordingly, one of the top frame spacers 4 contacts the handle base 16 and the other top spacer 4 engages the paddle handle 15, pivotally mounted on the handle base 16 of the conventional push/pull door latch 8, attached to a door 20, when the handle lock 1 is in locked configuration, as further illustrated in FIG. 1. Consequently, when the handle lock frame 2 is positioned on the handle base 16 and the paddle handle 15 with the top spacers 4 so oriented, the paddle handle 15 cannot be manipulated forwardly toward the door 20. Furthermore, the paddle handle 15 is prohibited from moving rearwardly by means of a clamp arm spacer 10 that extends between a pair of parallel clamp arm plates 11, to define a clamp arm 9 that is pivoted on the middle frame spacer 6, as hereinafter further described. When the clamp arm 9 is in the locked position between the parallel side plates 3 of the handle lock frame 2 as illustrated in FIG. 1, the clamp arm pilot holes 12 register with corresponding frame pilot holes 7, located in the respective side plates 3 of the handle lock frame 2, facilitate extending the locking bar 32 of a padlock 30 therethrough, to maintain the clamp arm 9 in locked configuration as illustrated in FIG. 1. Accordingly, it will be appreciated from a consideration of FIGS. 1 and 4 that while the handle lock 1 is in the locked configuration, the paddle handle 15 can be pivoted neither forwardly nor rearwardly on the handle base 16, and the handle bolt 18, extending from the door 20, cannot therefore be depressed and the door 20 opened.

Figure 3:
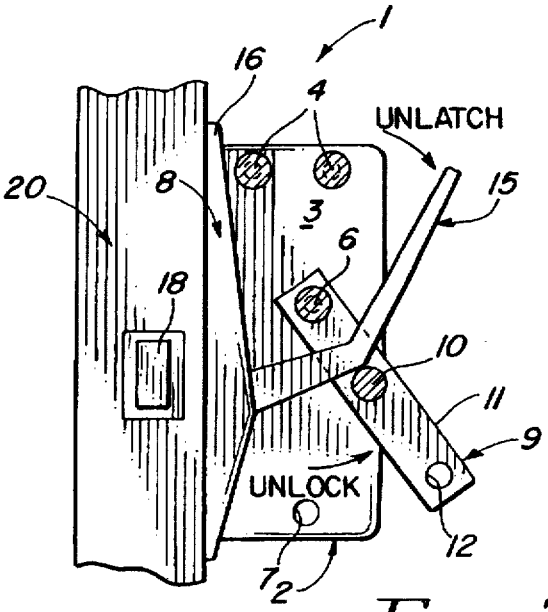
FIG. 3 is a sectional view taken along line 2—2 of the handle lock and door latch illustrated in FIG. 1, with the clamp arm pivoted outwardly of the handle lock frame, thereby freeing the paddle handle for manipulation to open the door in the direction of paddle handle push or pull.
Figure 5:
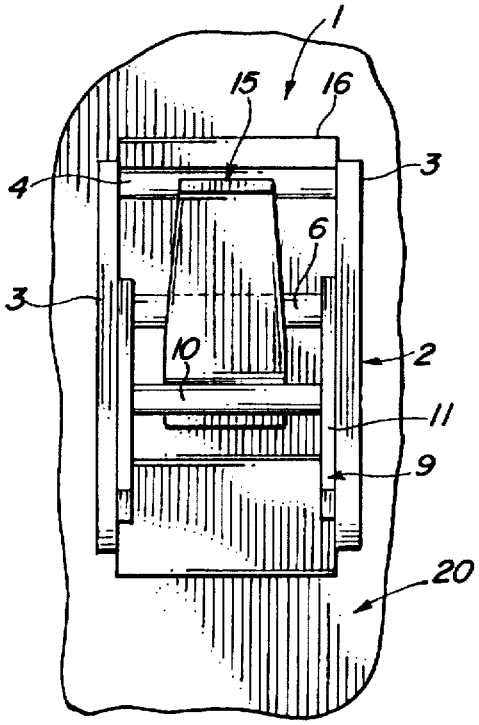
FIG. 5 is a front view of the handle lock and door latch illustrated in FIG. 1 in the unlocked configuration illustrated in FIG. 3.

Referring now to FIGS. 3 and 5 of the drawings, under circumstances where it is desired to free the paddle handle 15 for opening the door 20 responsive to recessing of the latch bolt 18 into the door 20, the padlock 30 is unlocked, typically with a key or by means of a combination, as desired, and the locking bar 32 is extended from the padlock housing 31 and removed from the registering frame pilot holes 7 and clamp arm pilot holes 12, respectively. This facilitates pivoting of the clamp arm 9 outwardly on the middle spacer 6 as illustrated in FIGS. 3 and 5, thus allowing the paddle handle 15 freedom to move between the middle spacer 6 and the clamp arm spacer 10 to depress the latch bolt 18 in the door 20 in conventional fashion and pull the door 20 open. Alternatively, when the clamp arm 9 is pivoted outwardly on the middle spacer 6 as illustrated in FIGS. 3 and 5, the entire handle lock frame 2 can be removed from contact with the handle base 16 and the paddle handle 15, as desired, to facilitate pushing the paddle handle 15 and opening the door 20, depending upon the push/pull design of the door latch.

Figure 6:
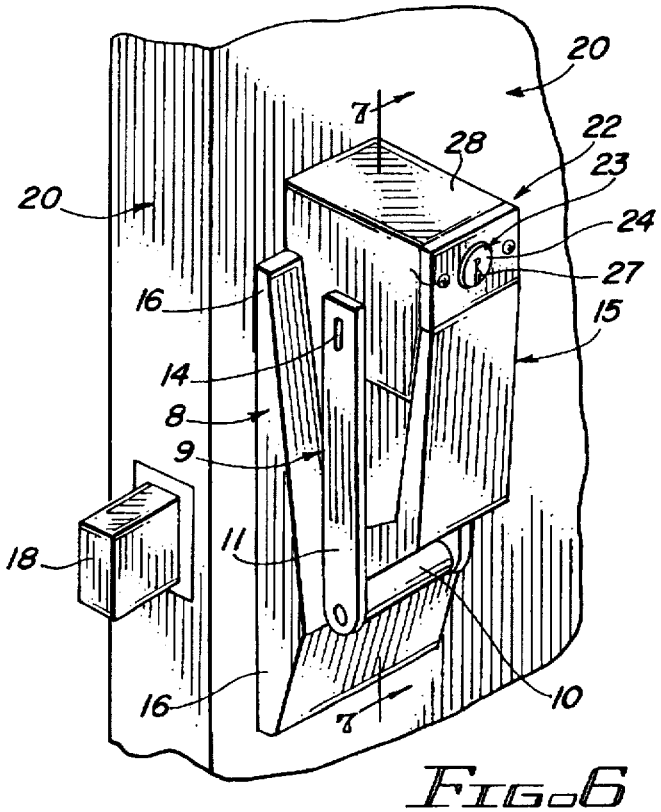
FIG. 6 is a perspective view of a second preferred embodiment of the paddle handle locks, illustrating a lockset handle lock in locked configuration on a paddle-type door latch.
Figure 7:
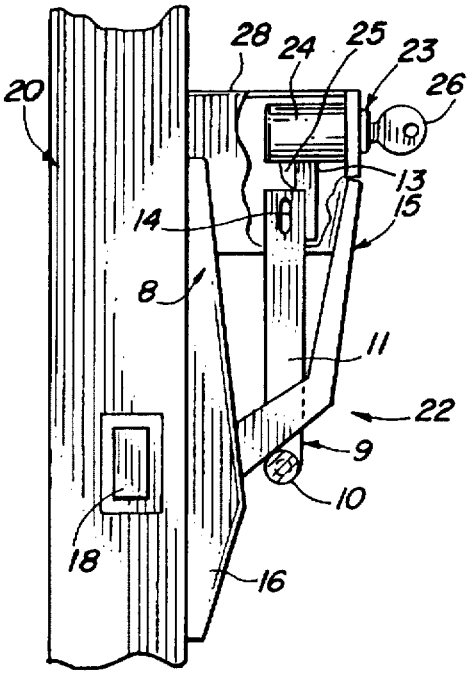
FIG. 7 is a side view, partially in section, of the locked lockset handle lock and door latch illustrated in FIG. 6.
Figure 9:
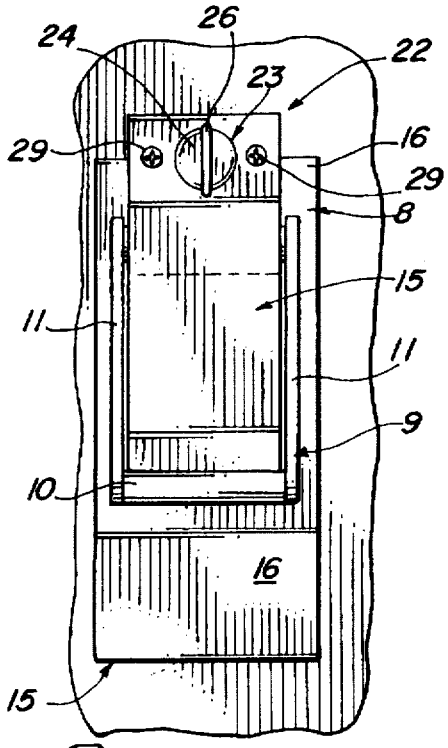
FIG. 9 is a front view of the lockset handle lock in locked configuration, as illustrated in FIG. 6.

Referring now to FIGS. 6, 7 and 9 of the drawings, in another preferred embodiment of the invention the paddle handle lock of this invention is characterized by a lockset handle lock 22, which includes a cylinder lock 23, encased in a lock housing 28 and fitted with a rotatable cylinder 24, provided with a cylinder bolt 25 which is activated by a key 26, inserted in a key slot 27, provided in the end of the cylinder 24, as illustrated. The lock mount screws 29 serve to mount the cylinder 24 in the lock housing 28. As further illustrated in FIG. 7, the cylinder bolt 25 normally engages a bolt-engaging plate 13, which is mounted on the top ends of the clamp arm plates 11 of the clamp arm 9, each of which clamp arm plates 11 is pivotally attached to the lock housing 28 by means of a clamp arm pin 14, as heretofore described. Accordingly, when the cylinder 24 is positioned as illustrated in FIG. 7 by operation of the key 26 such that the cylinder bolt 25 engages the upward-standing bolt-engaging plate 13, the paddle handle 15 is prevented from moving either forwardly or rearwardly with respect to the latch base 16. The door 20 is therefore effectively locked, since the latch bolt 18 cannot be depressed inside the door 20 by manipulation of the paddle handle 15 in conventional fashion.

Figure 8:
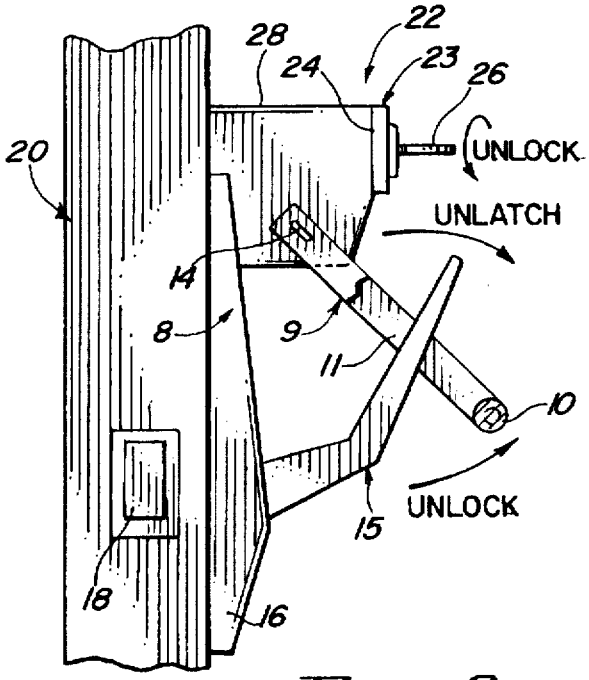
FIG. 8 is a side view of the lockset handle lock illustrated in FIG. 6, with the clamp arm 9 pivoted outwardly in unlocked configuration and the door handle free to pivot and open a door in the direction of push or pull.
Figure 10:
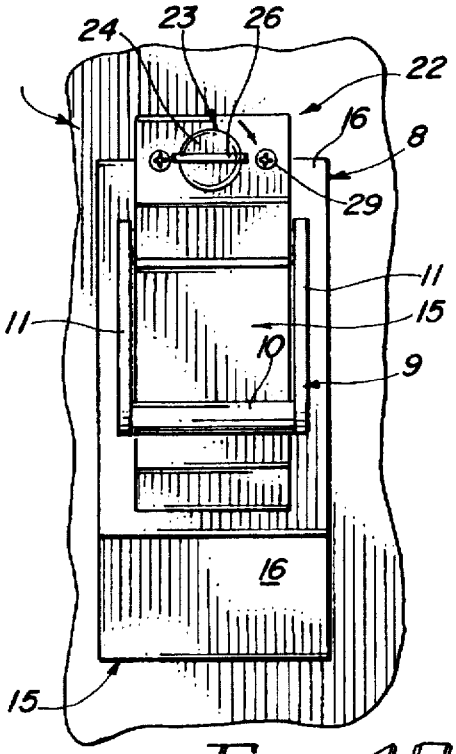
FIG. 10 is a front view of the lockset lever lock in unlocked configuration, as illustrated in FIG. 8.

Referring now to FIGS. 8 and 10 of the drawings, under circumstances where it is desired to operate the lockset handle lock 22 to release the paddle handle 15 for pushing or pulling to open the door 20, the key 26 is manipulated from the position illustrated in FIG. 7 to the position illustrated in FIG. 8. This action rotates the cylinder 24 and the cylinder bolt 25 and disengages the cylinder bolt 25 from the bolt engaging plate 13, which action allows upward pivoting of the clamp arm 9 on the respective clamp arm pins 14, to the position illustrated in FIG. 8. This outward positioning of the clamp arm 9 allows freedom of movement of the paddle handle 15 to depress the latch bolt 18 in the door 20 and open the door 20 in conventional fashion. The lockset handle lock 22 can then be easily removed from its normal position between the latch base 16 and the paddle handle 15, as illustrated in FIGS. 6 and 7.

It will be appreciated by those skilled in the art that both the handle lock 1 and the lockset handle lock 22 of this invention may be positioned on conventional push/pull, paddle-type door latches to prevent the paddle handle 15 from either being pushed or pulled to activate and recess the latch bolt 18 and open the door 20. Accordingly, both the handle lock 1 and the lockset handle lock 22 may be used to quickly and efficiently lock a door 20 equipped with a push/pull, paddle-type door latch. Furthermore, while the paddle handle 15 illustrated in FIGS. 1–10 of the drawings is shown in the upwardly-extending configuration from the handle base 16, it will be appreciated that both the handle lock 1 and the lockset handle lock 22 can be inverted from the positions illustrated in the drawings and mounted on downwardly-extending paddle handles 15, as well. Moreover, it will be further appreciated by those skilled in the art that the handle lock 1 and the lockset handle lock 22 of this invention can be constructed of various materials including metals such as aluminum, steel and the like, as well as plastic, fiberglass and other materials well known to those skilled in the art.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A handle lock for a push-pull, paddle-type door latch having a base and a paddle handle pivotally attached to the base, said handle lock comprising a pair of frame plates and frame spacer means separating said frame plates, said frame spacer means spanning said base and said frame spacer means also engaging said paddle handle when said handle lock is in locked configuration and clamp arm means pivotally carried by said frame plates, whereby said clamp arm means is pivotally disposed between said frame plates and engages the paddle handle when said handle lock is in the locked configuration and said clamp arm means is pivotally extended from said frame plates and disengages the paddle handle when said handle lack is in the unlocked configuration.

2. The handle lock of claim 1 comprising lock means engaging said frame plates and said clamp arm means for securing said clamp arm means within said frame plates and maintaining said handle lock in said locked configuration.

3. The handle lock of claim 1 comprising lock means engaging at least one of said frame plates and said clamp arm means for securing said clamp arm means within said frame plates and maintaining said handle lock in said locked configuration.

4. The handle lock of claim 1 wherein said clamp arm means comprises a clamp arm characterized by a pair of clamp arm plates pivotally carried by said frame spacer means and clamp arm spacer means separating said clamp arm plates, said clamp arm spacer means engaging the paddle handle when said handle lock is in said locked configuration.

5. The handle lock of claim 4 comprising lock means engaging at least one of said frame plates and said clamp arm plates for securing said clamp arm between said frame plates and maintaining said handle lock in said locked configuration.

6. A handle lock for locking the paddle handle of a push-pull, paddle-type door latch having a base and a paddle handle pivotally attached to the base, said handle lock comprising a frame characterized by a pair of spaced-apart frame plates, a pair of top frame spacers connecting said frame plates, with said top frame spacers for engaging said base and selectively engaging said paddle handle, respectively; a middle frame spacer connecting said frame plates and spaced from said top frame spacers; a clamp arm characterized by a pair of spaced-apart clamp arm plates having one end pivotally connected to said middle frame spacer and a clamp arm spacer connecting said clamp arm plates, said clamp arm spacer selectively engaging the paddle handle, whereby said clamp arm plates are pivotally disposed between said frame plates, and one of said top frame spacers, said middle frame spacer and said clamp arm spacer engage the paddle handle when said handle lock is in the locked configuration and said clamp arm plates are pivotally extended from said frame plates, and said one of said top frame spacers, said middle frame spacer and said clamp arm spacer disengage the paddle handle when said handle lock is in the unlocked configuration and the paddle handle is manipulated to operate the door latch.

7. The handle lock of claim 6 comprising lock means engaging at least one of said frame plates and said clamp arm plates for securing said clamp arm between said frame plates and maintaining said handle lock in said locked configuration.

8. The handle lock of claim 7 comprising at least one lock opening provided in at least one of said frame plates and at least one of said clamp arm plates and wherein said lock means comprises a padlock for extending through said lock opening and securing said clamp arm plates between said frame plates when said handle lock is in said locked configuration.

9. A lockset handle lack far a push-pull, paddle-type door latch having a base and a paddle handle pivotally attached to the base, said lockset handle lock comprising frame means configured to selectively engage the paddle handle and seat on the base; key-operated cylinder means provided in said frame means; and a clamp arm characterized by a pair of clamp arm plates pivotally carried by said frame means, and clamp arm spacer means separating said clamp arm plates, said clamp arm spacer means normally engaging the paddle handle when said lock-set handle lock is in the locked configuration, whereby said clamp arm spacer means pivotally disengages the paddle handle responsive to operation of said key-operated cylinder means when said lockset handle lock is in the unlocked configuration.

10. The lockset handle lock of claim 9 wherein said frame means comprises a cylinder lock and said cylinder means comprises a key-operated cylinder rotatably disposed in said cylinder lock and a cylinder bolt carried by said cylinder, said cylinder bolt normally engaging means mounted to said clamp arm when said lockset handle lock is in said locked configuration and said cylinder bolt disengaging said means mounted to said clamp arm responsive to key-operated rotation of said cylinder when said lockset handle lock is in said unlocked configuration.

* * * * *